US006019799A

United States Patent [19]

Brown et al.

[11] Patent Number: 6,019,799

[45] Date of Patent: Feb. 1, 2000

[54] METHOD TO SPACE DYE YARN

[76] Inventors: Robert S. Brown, 6139 Robin St., Spartanburg, S.C. 29303; William M. Pascoe, Sr., 41 S. Howard St., Inman, S.C. 29349

[21] Appl. No.: 09/036,147

[22] Filed: Mar. 6, 1998

[51] Int. Cl.[7] ..... D06B 1/02; D06P 5/15

[52] U.S. Cl. ..... 8/483; 8/440; 8/499; 8/151.2; 28/212; 28/219

[58] Field of Search ..... 8/483, 499, 151.2, 8/440; 28/219, 220, 212; 68/205 R

[56] References Cited

U.S. PATENT DOCUMENTS

| | | | |
|---|---|---|---|
| 3,620,662 | 11/1971 | Miyamoto et al. | 8/479 |
| 3,899,903 | 8/1975 | Lapierre | 68/205 R |
| 3,915,113 | 10/1975 | Patone t al. | 68/205 R |
| 4,037,560 | 7/1977 | Lutz et al. | 68/205 R |
| 4,100,724 | 7/1978 | Bous | 68/205 R |
| 4,316,312 | 2/1982 | Vermeer et al. | 8/483 |
| 4,380,158 | 4/1983 | Bous | 68/205 R |
| 5,033,143 | 7/1991 | Love, III | 8/158 |
| 5,148,583 | 9/1992 | Greenway | 26/2 |
| 5,161,395 | 11/1992 | Wethington | 68/205 |
| 5,211,339 | 5/1993 | Zeiler | 239/295 |
| 5,235,733 | 8/1993 | Willbanks et al. | 28/105 |
| 5,331,829 | 7/1994 | Zeiler | 68/205 |
| 5,367,733 | 11/1994 | Zeiler | 8/149.1 |
| 5,491,857 | 2/1996 | Love, III et al. | 8/151 |
| 5,557,953 | 9/1996 | Massotte et al. | 68/205 R |

FOREIGN PATENT DOCUMENTS

| | | |
|---|---|---|
| 1958649 | 5/1971 | Germany . |
| 49-26996 | 7/1974 | Japan . |

OTHER PUBLICATIONS

Derwent Abstract of FR 2,650,311, Chouperba, Feb. 1991.

*Primary Examiner*—Caroline D. Liott
*Attorney, Agent, or Firm*—Terry T. Moyer; George M. Fisher

[57] ABSTRACT

This invention relates to a method and apparatus for space-dyeing yarns. A yarn sheet passes over a yarn-driven roll equipped with a digital sensor that tracks the position of the sheet as it then passes through a dyeing apparatus. A computer precisely controls the spray application of dyes at the desired locations on the length of the yarn sheet. Undyed areas and areas of unwanted overlap of dyes are virtually eliminated, reducing the amount of off-quality yarn produced versus conventional methods. Sprayed dye droplets are collected and reused.

7 Claims, 10 Drawing Sheets

FIG. —4—

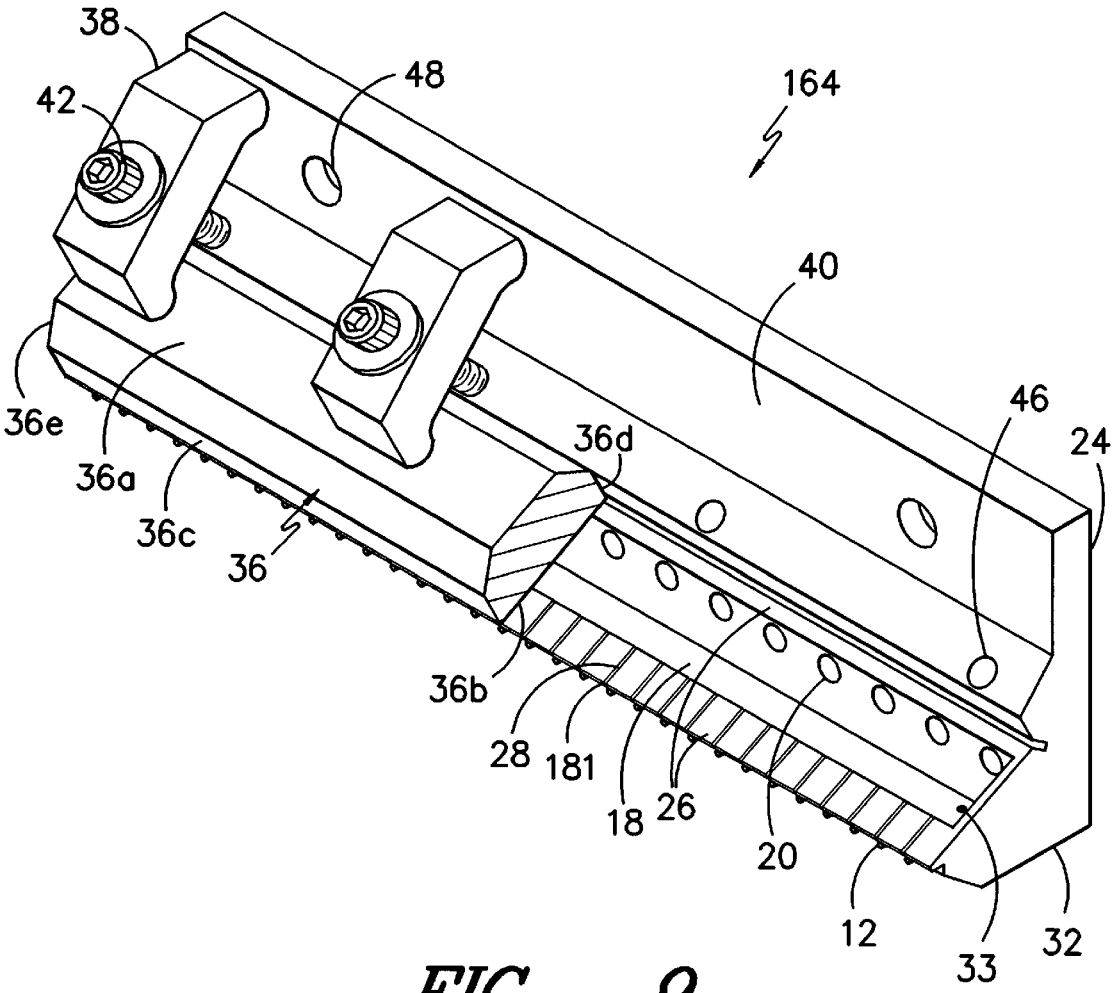
FIG. —9—

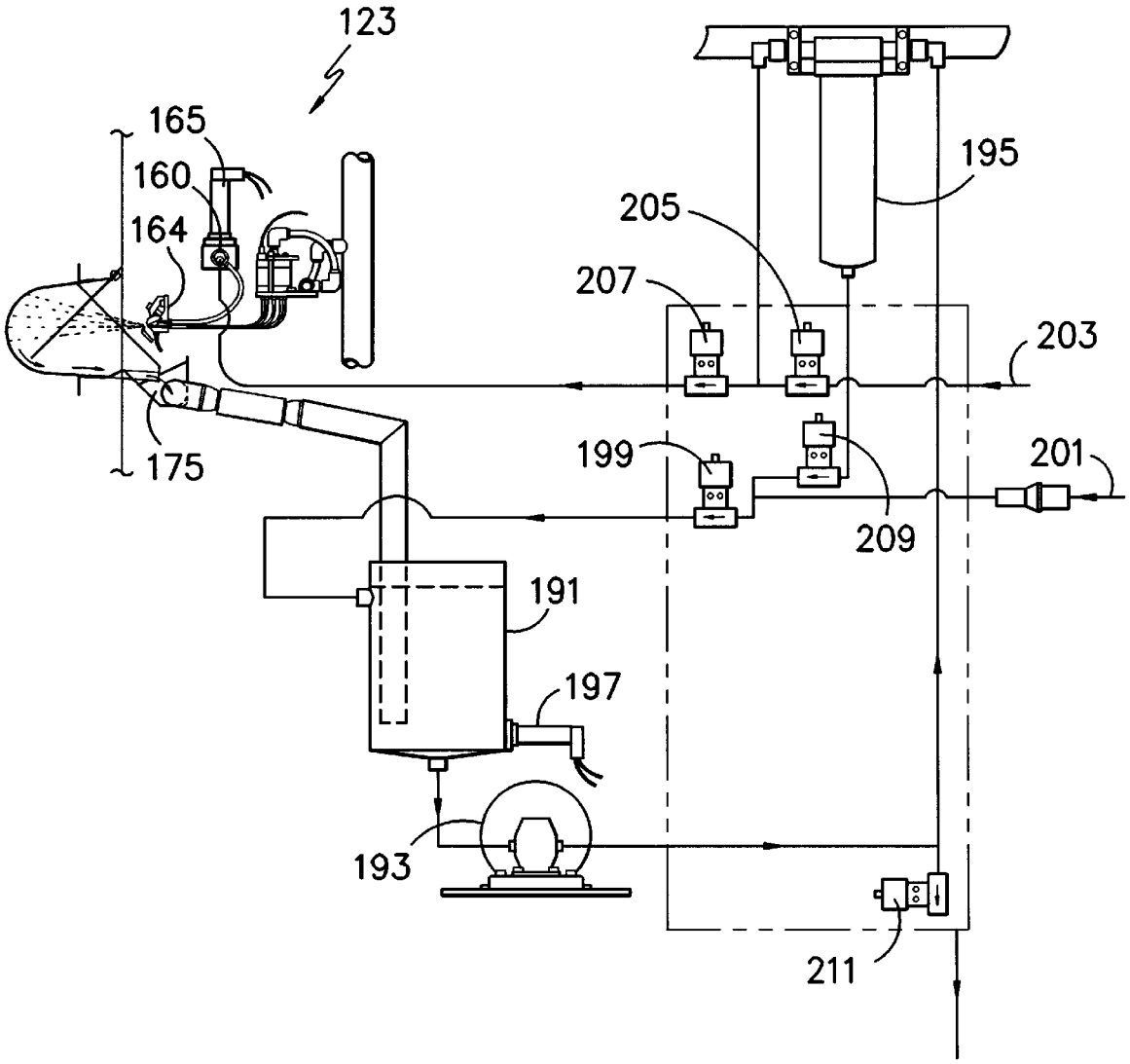
FIG. —10—

METHOD TO SPACE DYE YARN

This invention relates generally to an improved method and apparatus for the continuous dyeing of yarn. More specifically, this invention relates to a method and apparatus for spraying dyes or other patterning liquids onto a moving yarn sheet in which a yarn sheet drive roll and liquid application jets are coordinated to provide for the application of several different liquids in accordance with a predetermined pattern and with precision registration, thereby providing the ability to apply such liquids to the moving yarn sheet with no unintended untreated or overlapped sections, and in which the dye that passes through the yarn sheet is collected and recirculated for reuse.

BACKGROUND OF THE INVENTION

The production of yarn having different dyes spaced along its length is termed "space dyeing." Space-dyed yarns are desirable because they easily may be formed into textile fabrics that have an inherent random or pseudo-random pattern imparted by the patterning of the yarns comprising the fabric. While other methods of imparting a similar pattern to textile fabrics are well known, they are more difficult and require more steps than the present invention.

Several methods for space dyeing of yarns are known. Among batch-type processes (in which a predetermined quantity of yarn is treated at one time), for example, it is known to inject yarn packages with a number of different colored dyes to yield a space-dyed product. However, such batch processes are often more costly and require more product handling than continuous processes. Continuous space-dyeing processes (in which moving yarns are individually or collectively treated) are also known. Typically, dye may be applied by a series of rollers, or may be sprayed on individual yarns or yarn sheets. While generally more efficient than package dyeing techniques, these continuous dyeing processes often experience difficulties with dye mist and drips, resulting in unwanted marks and wasted dye liquor. Furthermore, dye overspray from the various colors being applied often mixes together in a single collection system and must be discarded, resulting in added costs for replacement dye as well as for waste handling and disposal.

In addition to the problems recounted above, none of these methods has been able to solve the problems of imperfect registration of the dye pattern. That is, often the yarns produced by these methods exhibit undesirable undyed areas, or areas in which an overlapping of different dyes results in undesirable colorations. Attempts to eliminate undyed areas by providing a constant overspray of dye have resulted in the use of more dye than the instant invention, resulting in a higher cost per pound of yarn, in addition to the necessity of adjusting dye formulations to compensate for the color imparted by the overspray. Such attempts also tend to exacerbate the problem of undesirable overlapping of adjacent dyed areas, and lead to space-dyed yarns in which the overall result is neither predictable nor controllable.

SUMMARY OF THE INVENTION

The present invention improves upon the methods discussed above. This invention may be used to apply any type of liquid colorant or patterning agent, including, but not limited to, acid dyes, disperse dyes, or pigments, as well as liquids other than dyes, to a moving yarn sheet. Any liquid yarn treatment agent, including, but not limited to, dye resists, water resists, finishing chemicals, or other treatments may be applied. Liquids may be applied at ambient temperature, or the temperature may be manipulated as desired or required for a particular chemical. Thickeners may be added to the liquids to alter the viscosity as desired or required. For illustrative purposes only, the invention will be described using the application of liquid dyes at ambient temperature.

A yarn sheet passes over a yarn driven roll equipped with a sensor which tracks the position of the sheet as it passes through the dyeing apparatus of the instant invention. Dyeing is controlled by a computer which, is programmed to selectively activate and deactivate dye jets in accordance with pattern data in response to position data from the sensor. In this way, dyes are applied precisely at pre-specified locations along the length of the moving yarn sheet. Dyeing takes place when the computer generates a signal that causes an air valve to open, forcing dye liquor from a recirculating dye system to be formed into droplets that are sprayed onto the yarn sheet. The sensor and computer-controlled dye jets work together so that undyed areas and areas of unwanted overlap of dyes are virtually eliminated, reducing the amount of off-quality yarn produced versus conventional methods.

The invention is not limited as to the yarn that may be processed. Yarns of various sizes (deniers) and kinds, such as filament or spun, and of any fiber type, such as cotton, polyester or nylon, may be processed using the invention. The selection of jet size will vary according to the yarn size, yarn type, yarn composition, speed at which the yarn sheet is run, and pattern effects desired.

The present invention includes a dye overspray collection system that reduces the back-spatter of dye droplets or mist onto portions of the yam sheet and reduces the quantity of dye that must be discarded due to the commingling of different color dyes. That portion of the dye sprayed in the direction of the yarn sheet that does not strike the sheet and that is not absorbed by the yarn (i.e., the overspray) is intercepted by a wire mesh screen, which reduces splatter onto the rearward-facing surface of the yarn sheet (opposite the dye jets) and allows the droplets to condense and flow down into a dye catch basin. The dye is then sent back to a dye tank, from which dye is drawn and pumped to the dye jet. A separate system is provided for each dye, thereby preventing commingling of different dyes and thereby reducing the amount of dye waste generated. This results in reduced dye costs and reduced costs in waste handling and disposal.

Yet another feature of the instant invention is a drip collection system. A drip collector is positioned under each dye jet to catch drips generated by the jets that might otherwise produce undesirable spotting on the yarn sheet. Dye caught by the drip collectors is directed into the dye catch basin and recirculated for use, as described above.

A further feature of the present invention is a vacuum exhaust system that collects dye mist (small airborne liquid particles of dye) that may be circulating near the yarn sheet, thereby preventing spotting of the yarn sheet by the mist.

Still another feature is a drain which is part of the dye jet system. This drain clears air and foreign particles from the dye jet area, enabling the jet to function properly by reducing spatter and clogging.

BRIEF DESCRIPTION OF THE DRAWINGS

The above as well as other features of the invention will become more apparent from the following detailed description of the preferred embodiments of the invention, when taken together with the accompanying drawings, in which:

FIG. 9 is a perspective view in partial section, as viewed from above, of the air stream/dye stream formation module that is shown in FIGS. 7 and 8.

FIG. 10 is a schematic depiction of the dye flow system.

DESCRIPTION OF PREFERRED EMBODIMENTS

Figure 1:
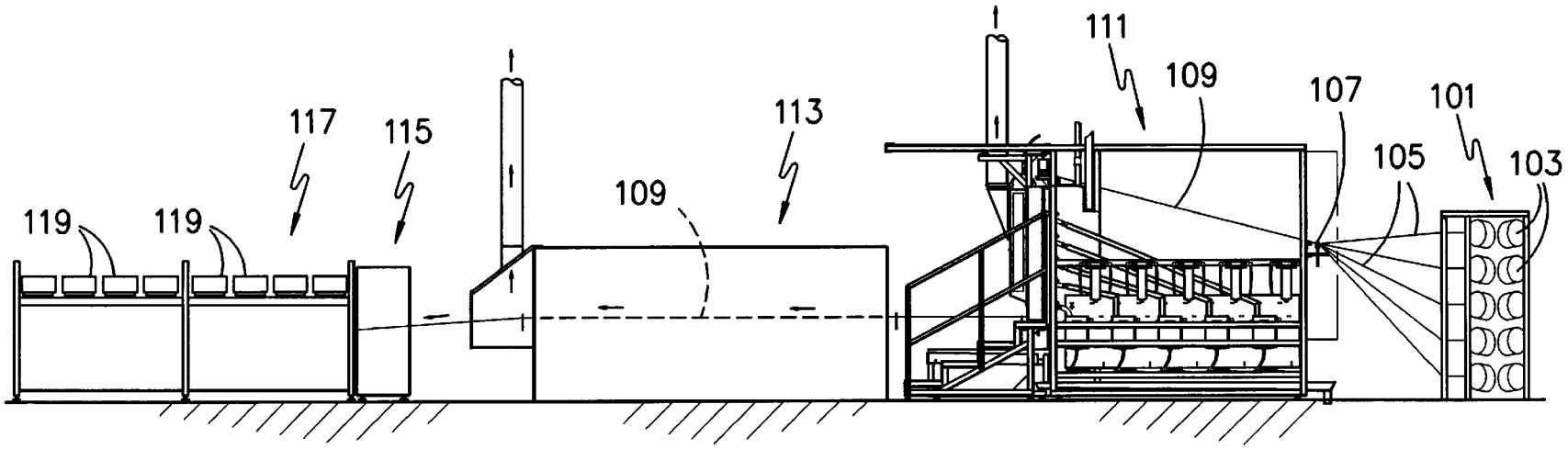
FIG. 1 is a side view of a space dyeing range embodying the instant invention.

This invention includes, but is not necessarily limited to, embodiments having one or more of the following features. A number assigned to a certain element shown in a drawing remains consistent throughout the drawings. Referring to the Figures, FIG. 1 shows diagrammatically a typical space dyeing range embodying the instant invention. Since dyeing multiple yarns is more practical than dyeing a single yarn at a time, the invention was designed with a creel 101 which holds a plurality of yarn packages 103. An individual yarn ("yarn end") 105 from each yarn package 103 is unwound and passed through a first comb 107 which positions each yarn end 105 in uniformly spaced, parallel fashion, so that the yarns do not overlap and are properly spaced to form a yarn sheet 109. The yarn sheet 109 enters the dye applicator section 111 of the range, which will be described below. After dyeing, the yarn sheet 109 exits the dye applicator section 111 and passes through a drying oven 113. After exiting the drying oven 113, the yarn sheet 109 enters a yarn inspection system 115 that counts the yarn ends 105 to detect any breakage. The yarn ends 105 are then wound by a winder 117 into packages 119. The packages 119 of dyed yarn are later fixed by an appropriate method, such as by autoclaving, then washed to remove any excess, unfixed dye, and dried. All processes and equipment prior to and following dye applicator section 111 are conventional. Although not shown, it is possible to incorporate the present invention into a continuous process of yarn drawing, dyeing, and heat setting. Such a process could be performed in the order stated, but is not restricted to that particular order.

Figure 2:
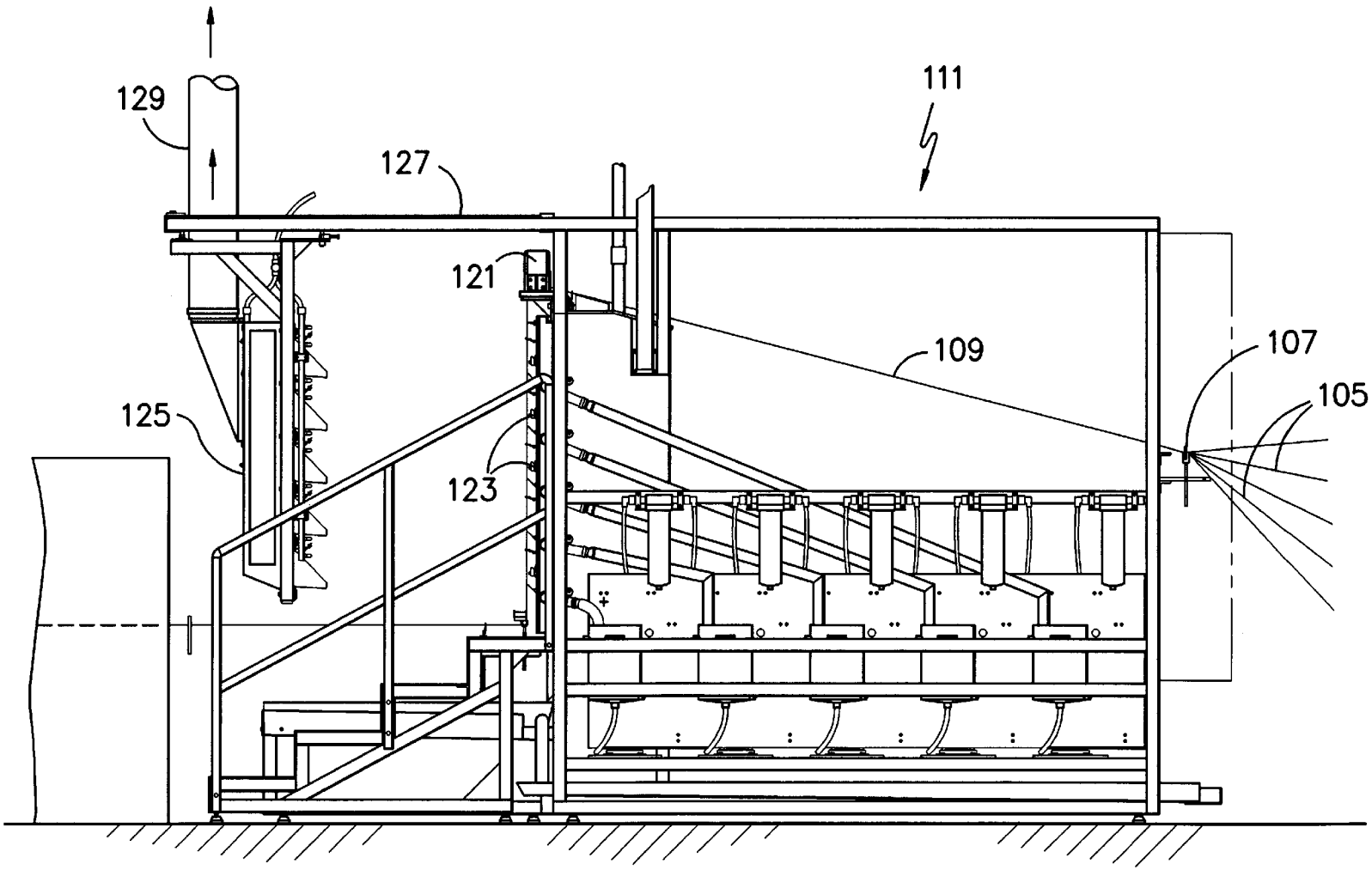
FIG. 2 is a side view of the dye applicator section that is part of the range shown in FIG. 1, with the overspray collection system moved back for machine cleaning or threading.

Moving now to FIG. 2, which depicts in greater detail the dye applicator section 111 of the dyeing range shown in FIG. 1, individual yarn ends 105 pass through a first comb 107 of conventional design that arranges the ends into a yarn sheet 109 in which the individual yarn ends are arranged in parallel fashion in the same plane. The yarn sheet 109 passes over a yarn-driven roll 149, here hidden by housing 121 but shown in FIG. 4, and then passes in front of a plurality of dyeing stations 123, which will be described in greater detail below. Although the instant invention is described in connection with use for space dyeing, which results in yarn with different colors along its length, the invention could also be used to produce uniformly colored yarn. Accordingly, to achieve a desired effect, each dyeing station 123 could apply a different color of dye, or several stations 123 could apply the same color, or all could apply the same color. Spraying a color on top of a different color results in a blend, which may be desirable. To eliminate unintended undyed areas along the length of the yarn sheet, dyed areas should overlap slightly. The extend of such overlap necessary to avoid undyed areas may vary, depending upon machine speed, control system speed, and other factors. The number of individual dyeing stations 123 depends upon the color variety or uniformity desired.

Continuing with FIG. 2, an overspray collection system 125 is able to be moved laterally along a track 127. In this view, the overspray collection system 125 is shown pushed away from the individual dyeing stations 123 to provide access for threading or cleaning the machine. The overspray collection system 125 is equipped with an exhaust 129 that, when the collection system 125 is in place (see FIG. 3), collects and removes airborne dye mist generated by the dye application process and thereby prevents spotting of the yarn sheet 109 by the mist.

Figure 3:
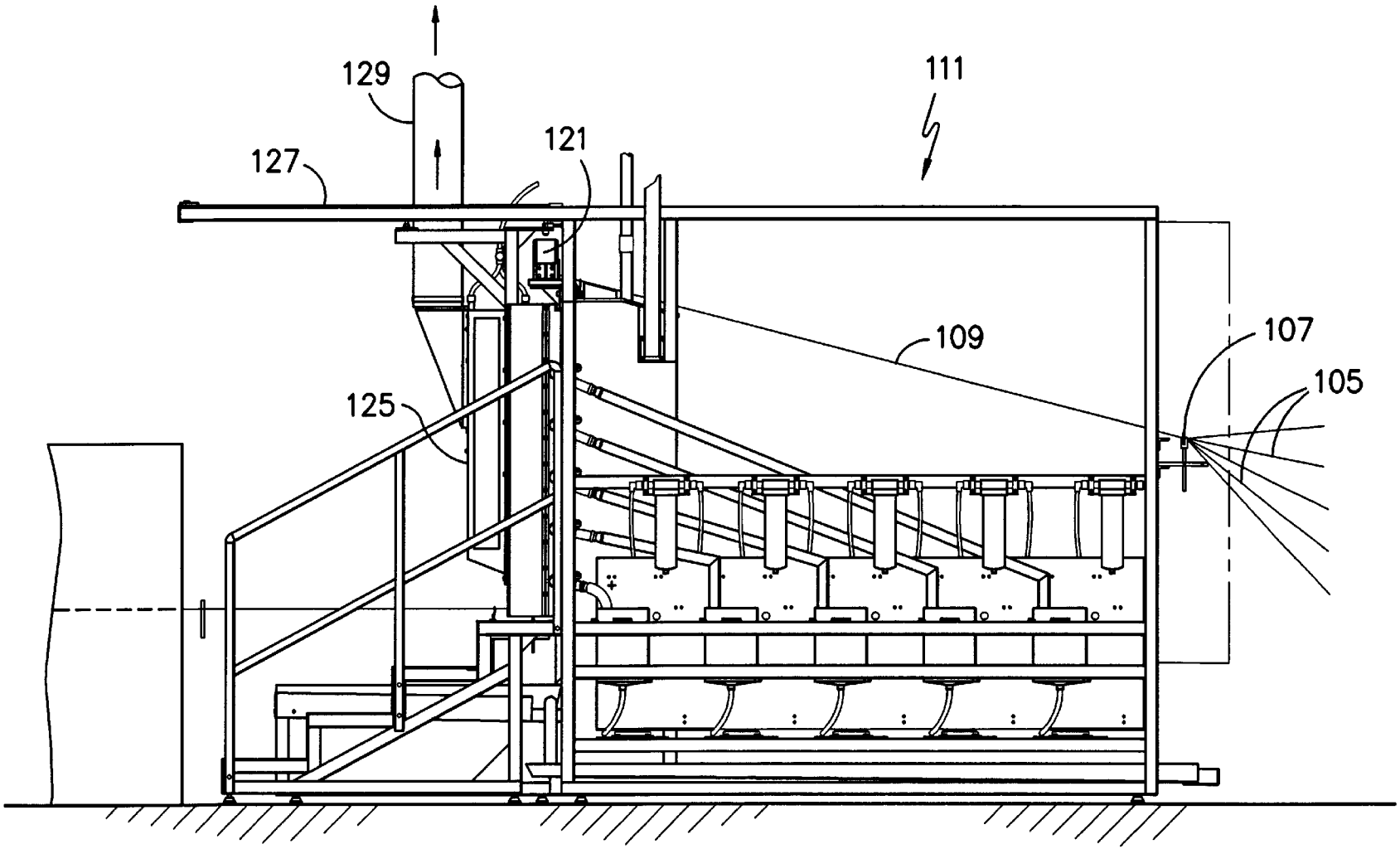
FIG. 3 is the dye applicator section shown in FIG. 2, with the overspray collection system moved into operating position.

FIG. 3 shows the dye applicator section 111 described in FIG. 2 with the overspray collection system 125 moved along its track 127 into operating position in close proximity to the individual dyeing stations 123.

Figure 4:
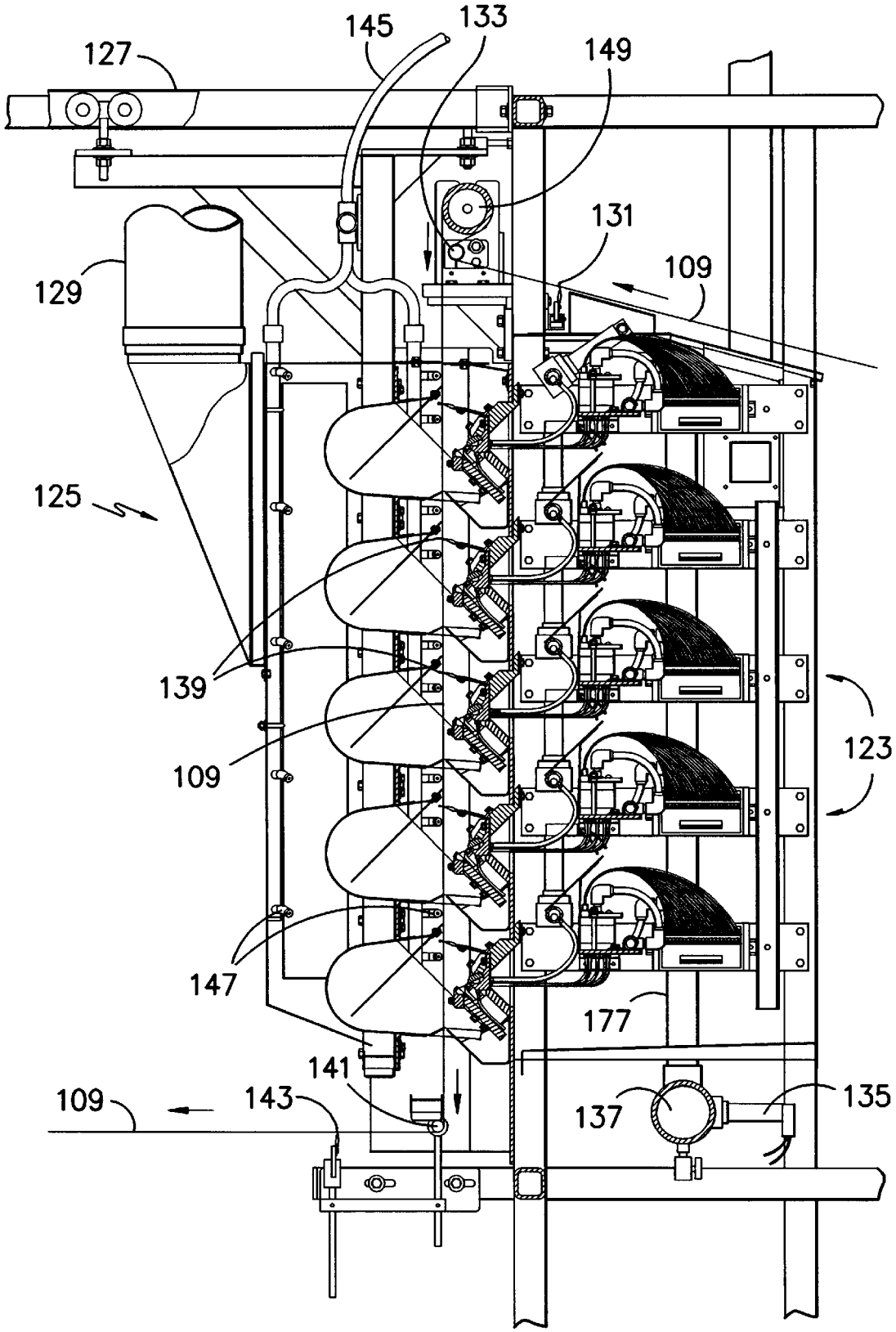
FIG. 4 is a partial cross-sectional view of a portion of the dye applicator section of FIG. 3, in which dye is sprayed onto a yarn sheet in response to pattern data, showing an array of five dyeing stations.
Figure 5:
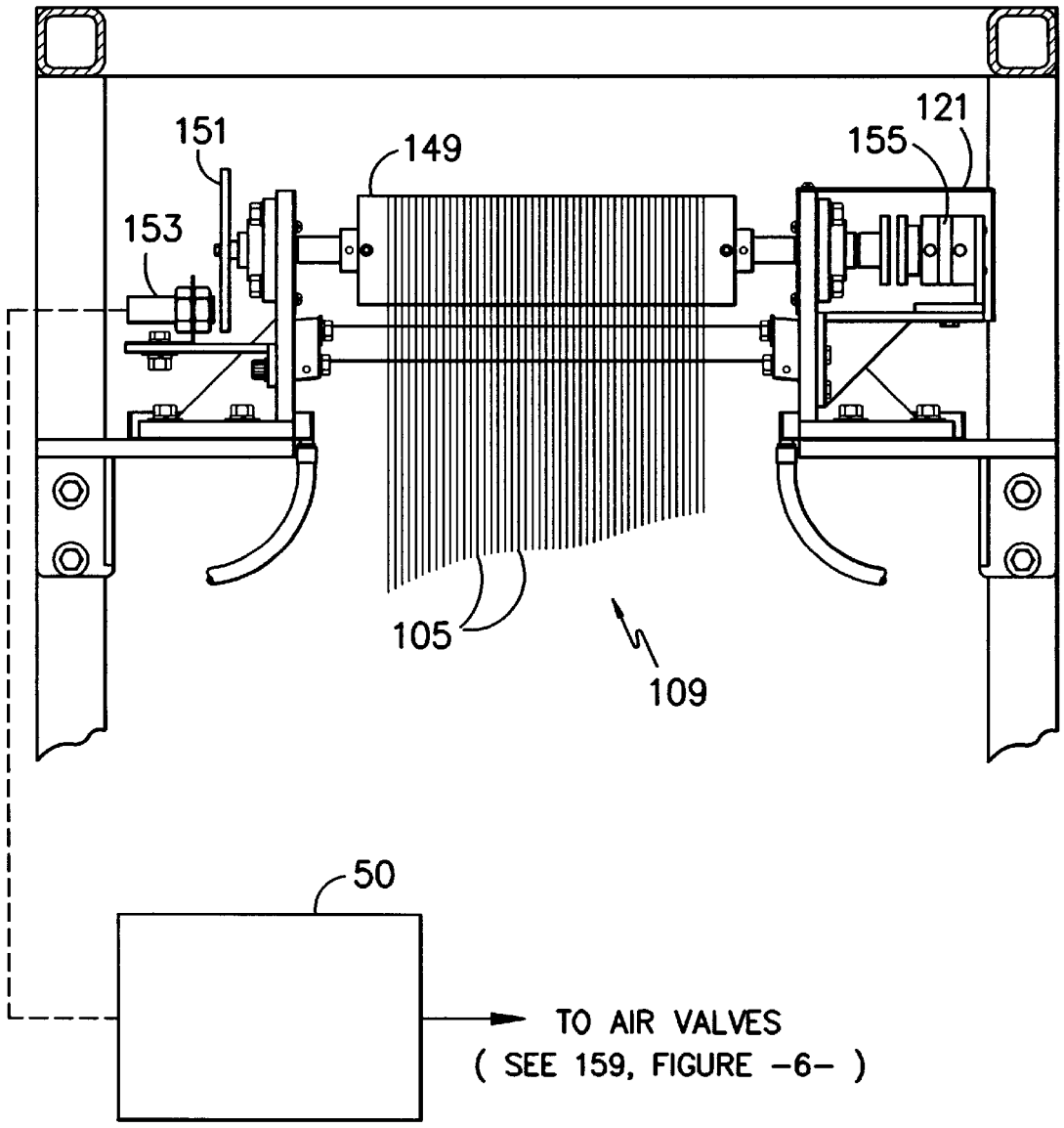
FIG. 5 shows a front view of a yarn sheet comprised of individual yarn ends passing over a yarn driven roll equipped with a sensor, as located near the top of the applicator section of FIG. 4.

FIG. 4 depicts a partial cross-sectional view of the left portion of the dye applicator section 111 of FIG. 3, showing a plurality of dyeing stations 123 and an overspray collection system 125 in the operating position indicated in FIG. 3. Having passed through comb 107 (shown in FIGS. 1–3), yam sheet 109 passes through a second comb 131, over a first non-rotating rod 133, and then over the top of a yarn-driven roll 149. As depicted in FIG. 5, a magnetic pulser disk 151, affixed to one end of roll 149, turns with roll 149. A rotary motion digital sensor 153 is associated with disk 151. Digital sensor 153 reads the position of the disk 151 as the yarn sheet 109 rotates roll 149. Specific rotational positions, or changes in such rotational positions, of the disk 151 correspond to discrete locations or movements along the length of yarn sheet 109. The digital sensor 153 sends the positional information to a controller or digital computer 50 which also contains patterning data, and can coordinate the actuation of the individual dye jets at each of the dyeing stations 123 in accordance with such data, using known programming techniques. Accordingly, the dye may be directed onto the yarn sheet 109 in response to actual yarn sheet 109 movement, and not in response to an assumed substrate web speed or the passage of an arbitrary time interval. Further details relating to this technique may be found in U.S. Pat. No. 4,923,743 to Stewart, the disclosure of which is hereby incorporated by reference. Either random or predetermined patterns may be stored in computer 50.

Also shown in FIG. 5, brake 155 is necessary to keep taut the yarn ends 105 comprising yarn sheet 109. The individual yarn ends 105 are pulled through the space dyeing range by a winder 117 (as shown in FIG. 1), and if only the winder 117 were to stop, roll 149 would continue to turn by inertia and would continue feeding the yarn ends 105, which would then tangle. To stop the yam ends 105 while maintaining tension, the brake 155 is applied to stop roll 149 (the yam ends 105 simply will slide over the stopped roll), after which the winder 117 is stopped.

Again referring to FIG. 4, dyeing at each of the dyeing stations 123 is performed by forming a stream of dye within the dyeing station 123, and selectively deflecting and dispersing the dye stream into the yarn sheet path in the form of droplets in accordance with externally supplied patterning information. Further details of this stream formation/deflection technique may be found in U.S. Pat. Nos. 5,211,339 and 5,367,733 to Zeiler, the disclosures of which are hereby incorporated by reference. An air pressure sensor 135 controls the pressure of air flowing to a machine air supply manifold 137 which extends across the width of the yarn sheet and serves as a source for the deflecting air used to redirect and disperse the dye stream generated by the dye jets. Each dyeing station 123 is equipped with a comb 139 to assure that yarn ends 105 remain spaced and in parallel relationship as they pass in front of that dye station. After passing in front of all dyeing stations 123, yam sheet 109 passes over a second non-rotating rod 141 and through a last comb 143 to assure proper separation of the yarn ends 105 before ends 105 enter drying oven 113 (see FIG. 1). FIG. 4 also shows water supply hose 145 which supplies water to a plurality of nozzles 147 for washing down the dyeing stations 123 and the overspray collection system 125, which will be described in more detail hereinbelow in connection with FIG. 10.

Figure 6:
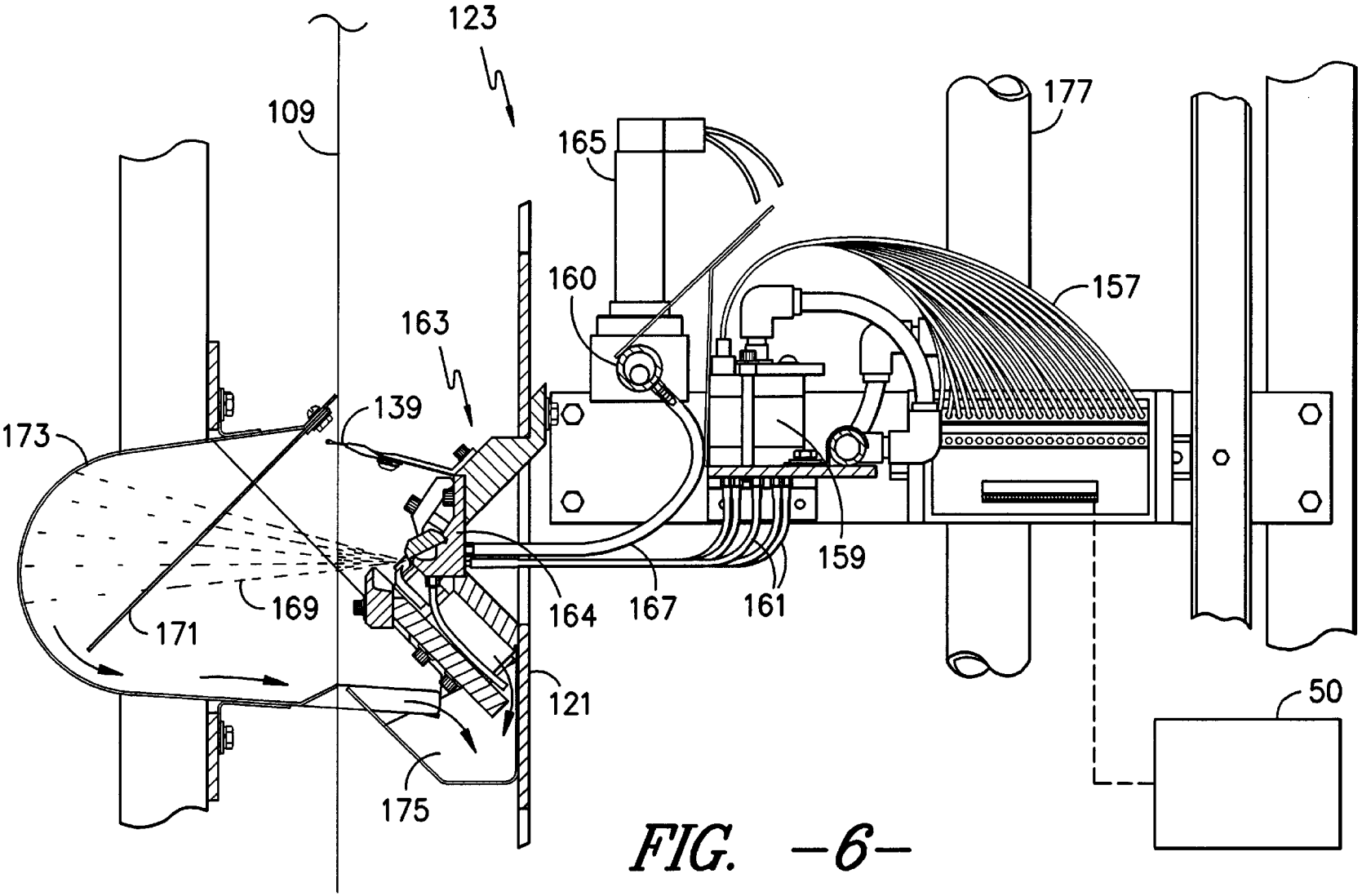
FIG. 6 is a cross-section of one of the five dyeing stations, and its associated overspray collector, from FIG. 4.

A cross section of a single dyeing station 123 and its associated overspray collection system is shown in FIG. 6. As yarn sheet 109 approaches dyeing station 123 at which an application of dye is desired, as determined by externally supplied patterning data accessible to computer 50, computer 50 sends appropriate actuation signals through a plurality of wires 157 connected to an array of air valves 159 positioned across the path of yarn sheet 109. Air valve array 159 is supplied with air by station air supply manifold 177, which in turn is supplied with air by machine air supply manifold 137 (FIG. 4). A plurality of individual air lines 161 run from a respective air valve 159 to the generally "V"-shaped dye application module 163, a portion of which is air stream/dye stream formation module 164, in which the dye streams and controlling air streams are formed and interact. As desired, the number of air valves 159 may be increased to provide greater flexibility in side-to-side patterning of yarn sheet 109; ultimately, each individual air line 161 may be connected to a separately controlled air valve 159. Dye application module 163 and air stream/dye stream formation module 164 are shown in more detail in FIGS. 7 and 8.

A dye pressure sensor 165 regulates the flow of dye through dyeing station 123. Dye is supplied continuously to dye pressure sensor 165 via dye supply manifold 160. Liquid dye is delivered to dye application module 163 via dye supply line 167 from dye supply manifold 160. The yarn sheet 109 is shown in a vertical orientation and the dye spray 169 is shown being delivered in a horizontal orientation; this perpendicular arrangement of yarn sheet 109 and dye spray 169 results in a generally circular spray pattern. Any of these orientations may be varied, as required, so long as care is taken to avoid unintended dye contact on the yarn sheet, as may occur through dye mist settling on the yarn sheet through gravity, through the influence of a draft generated by the movement of the yarn sheet, etc.

As dye liquid is sprayed onto the yarn sheet 109, some of the dye spray 169 passes between the individual yarns comprising sheet 109. Positioned opposite module 163 and beyond the plane of yam sheet 109 is a section of wire screen 171 that intercepts and breaks up the spray, assists in condensing or coalescing dye mist, and serves to shield the rearward side of yarn sheet 109 from back-scattered dye droplets that could be generated by the impact of unimpeded dye spray on the inside wall of collecting chamber 173. Screen 171 prevents undesirable spotting of the yarn sheet 109. The openings in the screen 171 must be large enough to be readily cleaned by the washdown nozzles 147 (FIG. 4), but not so large that dye droplets can pass through them without breaking up. Mesh sizes typical of readily available screening materials (e.g., about 100 to about 600 openings per square inch) are likely to be most effective.

The screen 171 is preferably positioned at an angle to the yam sheet 109 such that the screen is oblique to the yam sheet rather than parallel to it—a parallel arrangement tends to result in droplets bouncing straight back from the screen surface toward the rearward side of the yarn sheet 109. Relative screen angles (with respect to the yarn sheet) of about 25 to about 75 degrees should be satisfactory, with an angle within the range of about 40 to about 50 degrees being a preferred screen angle. It should be noted that, as the relative angle of screen 171 is increased, the effective size of the openings in relation to the size of dye droplets decreases, due to the oblique presentation angle encountered by the stream of dye droplets. Accordingly, it is possible to use screen mesh openings larger than the droplets while retaining the capability to break up the droplets.

Some of the dye liquid passes through the screen 171 and strikes the back of the overspray collection chamber 173, while the remainder of the liquid drips off of the screen 171; in both cases, the dye liquid flows by gravity down the inside wall of overspray collection chamber 173 and into catch basin 175 for recycling (which will be described in association with FIG. 10, below).

Figures 7, 7A:
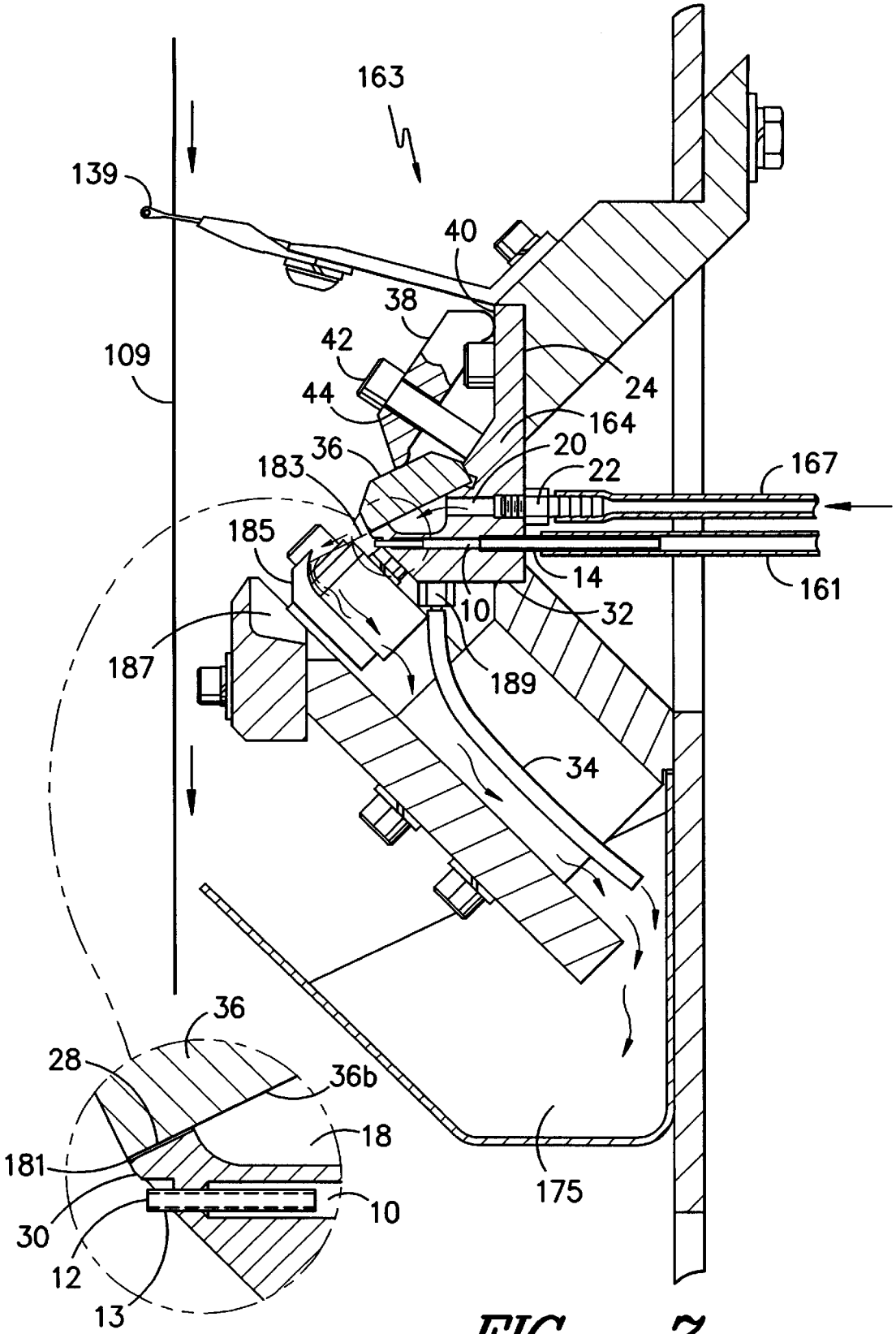
FIG. 7 is a close-up, cross-sectional view of the dye application module shown in FIG. 6; in this Figure, dyeing is not taking place.
FIG. 7*a* is a close-up, cross-sectional view of a portion of the dye application module in which the dye streams and controlling air streams are formed.

FIGS. 7 and 7A are close-up, cross-section views of a dye application module 163 in the inactive state, i.e., when the patterning data specify that no dye should be applied to yam sheet 109. Details of FIGS. 7 and 7A shall be explained with reference to FIG. 9, which shows, in a partial cut-away perspective view, the air stream/dye stream formation module 164 used to selectively direct and disperse the delivery of dye onto the yarn sheet 109. When dye is not being applied to the yarn sheet 109, air does not flow through the air lines 161.

Liquid dye enters the stream formation module 164 through dye supply line 167, which is operatively attached to module 164 by means of a threaded coupling 22 or similar means. The liquid dye then circulates through the stream formation module 164 by flowing first into dye chamber or trough 18 and then through jet-forming grooves 28 machined into the angled forward wall forming trough 18, as shown in more detail in FIG. 9. The dye flows through dye orifices 181, and is propelled under pressure across an open area 183 until the liquid dye encounters a deflector bar 185 that directs the liquid backward and downward so that it flows into catch basin 175.

Figure 8:
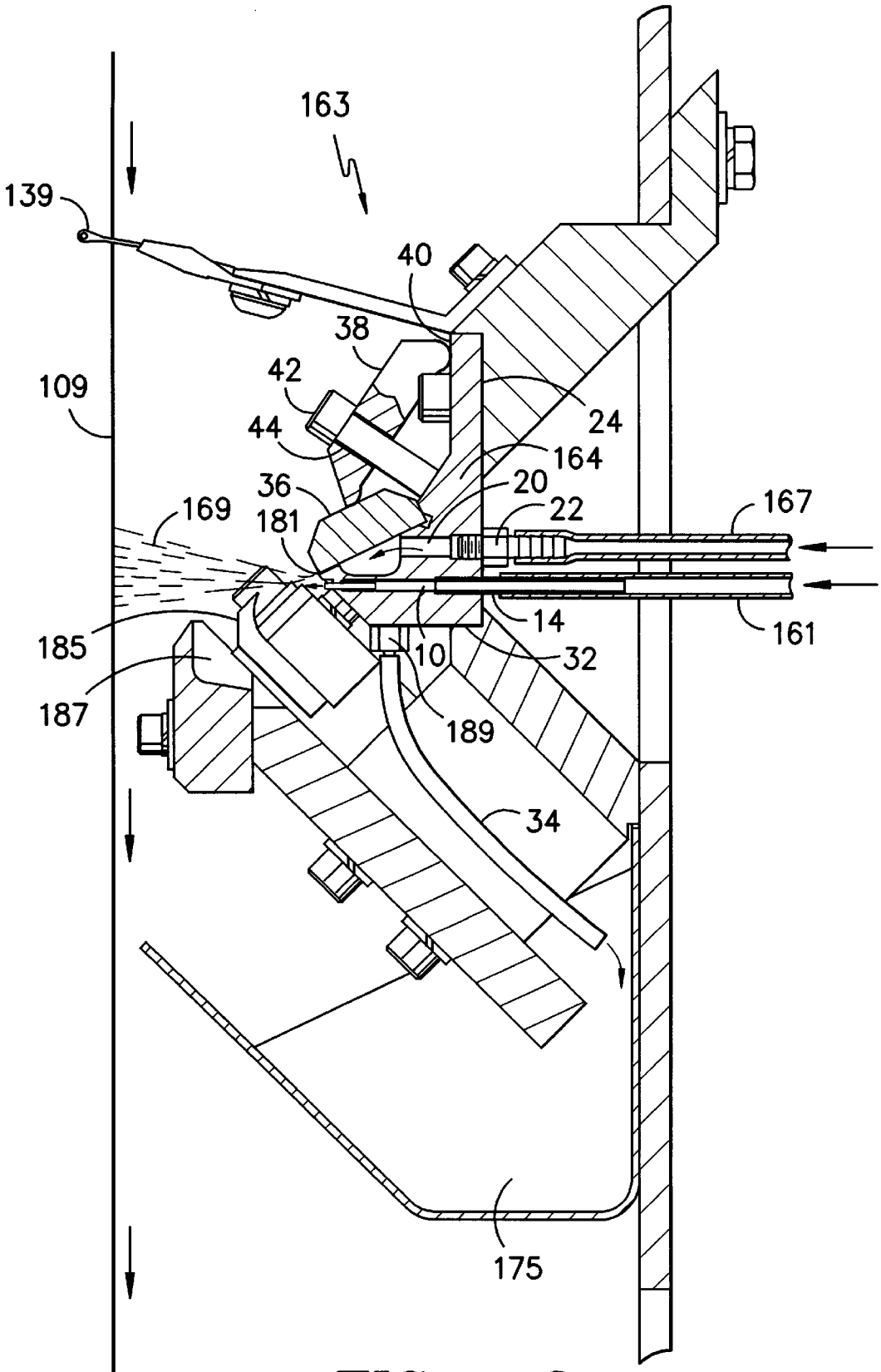
FIG. 8 is the dye application module of FIG. 7, but showing the application of dye to a yarn sheet.

Looking collectively at FIGS. 7–9, the dye channel or trough 18, formed within stream formation module 164, communicates with a number of dye conduits 20 along the rear wall 24 of trough 18. Dye conduits 20 are in fluid communication with threaded couplings 22 that communicate with the rear wall 24 of the stream formation module 164. Threaded couplings 22 provide a means for connecting the dye conduits 20 to dye supply lines 167, that in turn are connected to the dye supply manifold 160 (see FIGS. 6 and 10).

Upper planar surface 26 of stream formation module 164 has a plurality of dye grooves 28, each of which extends from trough 18 to the forward edge of stream formation module 164, thereby forming an array of dye orifices 181 directed at deflector bar 185. The present embodiment uses one dye orifice 181 per yarn end 105, with the dye spray 169 covering about three yarn ends 105, but other ratios could be employed. Dye grooves 28 are longitudinally spaced along upper planar surface 26 of stream formation module 164, preferably at uniform intervals that correspond to the level of lateral patterning detail desired. Most preferably, dye grooves 28 are spaced at uniform intervals corresponding to the spacing of each yarn end 105 comprising yarn sheet 109. It has been found that about five to about fifteen dye grooves 28 (and yarn ends 105) per inch are generally satisfactory, although spacings that are outside this range may also be used. To assure uniform application of dye across the width of the yarn sheet, each groove should have the same predetermined uniform cross-sectional area. The selection of dye groove 28 size will vary according to the yarn size and speed at which the yarn sheet is run, and the pattern effects desired. In one embodiment of the present invention, a square groove 0.018 inches per side was used.

Stream formation module 164 also contains individual bored air passages 10 (FIG. 7) positioned in spaced parallel fashion under trough 18. Each bored air passage 10 is connected to a respective air supply line 161 via a friction-fitted tube 14 of appropriate size. At the opposite end of each bored air passage 10 is fitted a second friction-fitted tube 13, the outside end of which forms an air orifice 12 (FIG. 7*a*). The diameter and cross-sectional shape of these tubes depend upon several factors, including the shape and mass of the dye stream to be controlled. Accordingly, the choice of tube size and shape is somewhat discretionary. Circular tubes having an outside diameter of about 0.050 inch and inside diameter of about 0.033 inch have been used in conjunction with the square 0.018 inch dye orifice 181 described above.

Collectively, air orifices 12 are longitudinally spaced along the lower front of stream formation module 164, preferably in one-to-one correspondence with dye grooves 28, so that each air orifice 12 is paired and aligned with a corresponding dye orifice 181. This arrangement allows the air streams from air orifices 12 to intersect the dye streams emerging from dye orifices 181, and effectively deflect and disperse the resulting dye spray in the direction of yarn sheet 109.

The upper cover plate 36 is a block of stainless steel having generally planar upper, lower, front, rear and side surfaces 36*a*, 36*b*, 36*c*, 36*d*, and 36*e*, respectively. A series of clamping members 38 is arranged to interact with mounting surface 40. The stream formation module 164 is assembled by placing lower surface 36*b* of upper cover plate 36 in parallel mating relationship with planar surfaces 26 of stream formation module 164, with side surfaces 36*e* of the upper cover plate flush with the side surfaces of stream formation module 164 and with the front surface 36*c* of upper cover plate 36 flush with front surface 30 of stream formation module 164. Threaded bolts 42 are then placed through the clearance holes 44 in the clamps 38 and are threaded into the upper fastening holes 46. Bolts 42 are tightened to cause clamps 38 to produce a liquid-tight seal between the upper cover plate 36 and the mating surfaces of stream formation module 164. Once assembled, module 164 provides an array of dye conduits for delivering dye and air through the module. The lower surface of upper cover plate 36 encloses dye grooves 28 to form covered dye conduits extending from trough 18 to dye orifice 181.

The assembled module 164 is used to spray patterns on a yarn sheet 109. FIG. 8 is a close-up, cross-sectional view of the application of a dye spray 169 to a yarn sheet 109. The stream formation module 164 is attached through mounting holes 48 (see FIG. 9) through the rear wall of stream formation module 164 to a mounting bracket associated with dye application module 163. As shown in FIG. 6, the pressurized dye source is connected to dye supply couplings 22 via dye supply manifold 160 and dye supply lines 167. Dye can then flow in a continuous path from the dye source, into trough 18, through the dye conduits formed by dye grooves 28 and out through dye orifices 181. Trough 18 preferably may be fitted with bottom-located dye bypass drain holes 33 (see FIG. 9), to which are connected fittings 189 and dye return conduits 34. Dye return conduit 34 drains into catch basin 175 for connection to the dye recirculation system (see FIG. 10). This bypass arrangement keeps some dye circulating in the system regardless of the output of the dye jets formed by groove 28, and provides for the capture of dirt and other contaminants in the dye, as well as for the removal of air bubbles in the dye.

More specifically, two general dye flow streams exist in trough 18. One stream (the supply stream) flows from the exit of each dye supply conduit 20 to the entrance of each dye conduit formed by dye groove 28. The second flow stream (the bypass stream) flows from the exit of each dye supply conduit 20 to the entrance of each dye bypass drain hole 33. In the undesirable event that a solid contaminant lodges itself at the entrance to a dye conduit formed by dye groove 28, thus restricting dye flow through that groove 28, it can easily be pushed away from the groove entrance and out of the supply stream and into the bypass stream by inserting a properly sized wire into the conduit from the orifice 181. The solid contaminant would then exit the trough 18 by way of dye bypass drain hole 33, through the dye return conduit 34 and into the. recirculation system (see FIG. 10) where it will be removed through filtration.

The pressurized air source is connected to air supply fittings 14. When air flow is desired, air can flow in a continuous path from the ultimate source of pressurized air, not shown, through station air supply manifold 177 (FIGS. 4 and 6) and an associated electromechanical air valve, indicated at 159 (FIG. 6), to air lines 161, air supply fittings 14, air supply channels 10, and out through air orifices 12.

The operation of a spraying apparatus employing a module of the present invention can be described by considering the operation of a single air conduit/dye conduit pair and with reference to FIG. 7. Dye is continuously supplied to trough 18 by dye supply lines 167 and flows out dye orifice 181. The dye stream emanating from dye orifice 181 flows unimpeded into the surface of diverting lip or blade 185, which collects the dye in catch basin 175 for disposal or recirculation to dye tank 191 (FIG. 10). An air control valve 159 operatively associated with station air supply manifold 177 prevents air from flowing to air supply fitting 14 and through air orifice 12 until patterning data so demands.

When dye from the dye stream is to be applied to the yarn sheet 109, pulses of air supplied by station air supply manifold 177 are generated by the opening and closing of the individual control valves 159 in accordance with pattern data supplied by computer 50, and are supplied to the respective air supply fittings 14 via individual hoses 161. As shown in the detail of FIG. 7*a*, the dye orifice 181 and air orifice 12 are positioned such that the dye is contacted with a pressurized stream of air after it exits from the dye orifice 181. As a result of the interaction of the higher pressure air stream (e.g., 10–20 p.s.i.g.) with the lower pressure dye stream (e.g., 2–4 p.s.i.g.), the dye stream is broken up into a spray of diverging droplets. The combined momentum of the two streams then carries the droplets to the surface of the yarn sheet 109. Any droplets of liquid that drip from the dye spray 169 fall into a drip collector 187 and then flow down into the catch basin 175.

The computer 50 is programmed to apply dye from a certain dyeing station 123 for a certain amount of time, which may be varied as desired to achieve a particular effect. Once the dye spray 169 has been applied for the desired amount of time, the computer 50 sends a signal to the air valve (159, FIG. 6) to close, turning off the flow of air through the appropriate hoses 161, and the dyeing station 123 returns to the inactive state depicted in FIG. 7. Because the dye exits the dye orifice 181 outside of the airstream envelope, aspiration of dye from the dye supply conduit is eliminated, thereby eliminating the need to create uniform aspiration across the width of the module.

FIG. 10 shows the dye flow system associated with each dyeing station 123. A dye tank 191 supplies dye liquid to a pump 193 that pumps the dye liquid to a filter 195 that removes foreign particles from the liquid. After filtering, the dye liquid is directed to dyeing station 123 via dye supply manifold 160. A dye pressure sensor 165 controls the amount of dye liquid that is supplied to stream formation module 164. When dyeing is taking place, as shown, dye liquid overspray and drips enter catch basin 175 and recirculate to dye tank 191. When dyeing is not occurring, the dye liquid is directed by a deflector bar 185 (see FIG. 7) into catch basin 175, whereupon the liquid recirculates to dye tank 191. Dye tank 191 is equipped with a dye level pressure sensor 197 that controls the amount of dye liquid in tank 191. When the amount drops to a certain level, dye level pressure sensor 197 causes a dye supply line valve 199 to open, allowing dye liquid from an alternate supply tank (not shown) to flow via dye supply line 201 into dye tank 191 until the level of dye increases to the desired level, at which time dye level pressure sensor 197 causes valve 199 to close. The dye flow system is equipped with a clean water line 203 and valves for automatic clean up, whereby dye in the system is drained and the dyeing system is operated with clean water substituted for dye. Water line valve 205 remains closed during normal dyeing operation, but is opened during automatic clean up to allow water to flow. Dyeing station supply line valve 207 is open during normal dyeing operation to allow for dye circulation. It can be closed during part of the cleaning cycle (e.g., when flushing filter 195), or opened to allow water to flow to dyeing station 123 for cleaning. Filter drain valve 209 is closed during normal dyeing operation and opened to drain filter 195 when necessary for cleaning. Waste disposal valve 211 remains closed during normal operation, and is opened to drain dye liquid or clean up water from the dye flow system to a waste disposal means.

Having described the principles of my invention in the form of the foregoing exemplary embodiments, it should be understood by those skilled in the art that the invention can be modified in arrangement and detail without departing from such principles, and that all such modifications falling within the spirit and scope of the following claims are intended to be protected hereunder.

We claim:

1. A process for applying droplets of liquid in accordance with a predetermined pattern to a moving sheet of individual yarns arranged in spaced, parallel relation, said process comprising:

(a) guiding a moving sheet of yarns along a pre-defined path, said sheet being comprised of individual yarns arranged in parallel relationship, with spaces between adjacent yarns;

(b) indexing the movement of said moving sheet along said pre-defined path by generating signals corresponding to the advancement of said moving sheet along said pre-defined path;

(c) correlating said signals with pattern data;

(d) directing a spray of liquid droplets into said pre-defined path, thereby applying a first portion of said sprayed liquid to said spaced adjacent yarns comprising said moving sheet as said moving sheet moves along said pre-defined path, and projecting a second portion of said sprayed liquid through spaces between said spaced adjacent yarns;

(e) collecting and recirculating said second portion of said liquid spray; and (f) pneumatically interrupting said spray of liquid droplets into said pre-defined path in accordance with said correlated signals, whereby said sprayed liquid droplets are applied only to select portions of said moving sheet in accordance with said pattern data.

2. The process of claim 1 wherein multiple sprays of liquid are directed onto said pre-defined path from locations that span the width of said path.

3. The process of claim 2 wherein multiple sprays of liquid are directed onto said pre-defined path from locations along the length of said path.

4. The process of claim 3 wherein said correlating of said signals allows said multiple streams of liquid droplets to contact said yarns comprising said moving sheet in patternwise registration.

5. The process of claim 3 in which said process for collecting and recirculating said second portion of said sprayed liquid comprises the step of intercepting droplets comprising said second portion of said sprayed liquid and condensing said droplets.

6. The process of claim 3 in which different liquids are sprayed simultaneously, and the collection and recirculation of said different sprayed liquids are accomplished separately so as to avoid any commingling of said different liquids.

7. The process of claim 6 in which said liquid collection and recirculating process further comprises a process for consolidating sprayed liquid from sprays at a given location along the length of said path and redirecting said consolidated liquid into said pre-defined path exclusively through sprays at said given location.

* * * * *